United States Patent [19]

Doherty

[11] Patent Number: 4,742,920

[45] Date of Patent: May 10, 1988

[54] LUMBER SORTING APPARATUS

[75] Inventor: Ralph D. Doherty, Jacksonville, Fla.

[73] Assignee: U.S. Natural Resources, Inc., Portland, Oreg.

[21] Appl. No.: 912,955

[22] Filed: Sep. 29, 1986

[51] Int. Cl.[4] ..... B07C 5/14

[52] U.S. Cl. ..... 209/517; 209/933; 414/268

[58] Field of Search ..... 209/517, 518, 520, 521, 209/933; 414/268, 49

[56] References Cited

U.S. PATENT DOCUMENTS

| | | | |
|---|---|---|---|
| 4,098,407 | 7/1978 | Moore | 209/517 |
| 4,104,156 | 8/1978 | Fletcher | 209/521 |
| 4,348,145 | 9/1982 | Marklund et al. | 414/268 |

FOREIGN PATENT DOCUMENTS

| | | | |
|---|---|---|---|
| 2722793 | 9/1978 | Fed. Rep. of Germany | 209/933 |
| 2521038 | 8/1983 | France | 209/517 |
| 410149 | 10/1979 | Sweden | 414/268 |

*Primary Examiner*—Robert B. Reeves
*Assistant Examiner*—Donald T. Hajec
*Attorney, Agent, or Firm*—Robert L. Harrington

[57] ABSTRACT

A lumber sorting apparatus wherein a bin collects graded lumber. Flexible straps across the bottom are elongated to expand the lumber holding capacity. One end of the strap has a releasable latch mechanism and latching of the straps (after dumping the lumber) is provided by a rigid pivotal arm that receives the latch mechanism in a rewinding operation and pivots the latch member into place for relatching. The latch mechanism consists of a spool that fits between sleeve portions through which a pin is controllably inserted and withdrawn by a manually operated air cylinder.

4 Claims, 1 Drawing Sheet

LUMBER SORTING APPARATUS

This application has similar disclosures to that of a simultaneously filed application, U.S. Ser. No. 913,028, having the same inventor and same assignee, the claims of which are directed to a different feature of the disclosure.

FIELD OF INVENTION

This invention relates to an apparatus that sorts and accumulates graded lumber, and more particularly to the design of a lumber dumping feature therefore.

HISTORY OF INVENTION

Lumber production has become highly mechanized and commercial success in this industry is largely dependant on being able to produce a high volume of product. Interruptions to the process needs to be avoided and thus maintenance problems must be minimized.

In a sling sorting apparatus, straps that form an elevated sling provide a cradle for lumber being sorted from an overhead conveyor system. When the sling fills up, the bundle of lumber it contains is lowered to an underlying floor. One end of the sling is unlatched and allowed to fall to the floor. The other end is reeled in to draw the free end from under the lumber. As the free end is drawn back up into position (toward said reel and thus on the side of the bin opposite to where it needs to be relatched) a pivotal relatching arm is engaged by the free end of the strap and further reeling in of the strap forces pivoting of the arm (and the strap end) over to the latching mechanism. The sling is then ready to receive the next allotment of sorted lumber pieces.

Heretofore a major problem with the mechanism described involved the latching mechanism. Complicated mechanisms such as shown in U.S. Pat. Nos. 4,098,407 and 4,104,156 are prone to frequent breakdown and maintenance requirements. An objective of this invention is to provide a simplified latching mechanism that involves few moving parts, is reliable and subject to automatic operation, can be rapidly replaced and/or maintained at low cost, but will operate for long periods of time without requiring maintanence or replacement.

BRIEF DESCRIPTION OF INVENTION

In the preferred embodiment of the present invention, the strap end to be latched is looped over a rigid spool-like member having a center hole through it. An overhead support carries spaced guide sleeve portions that are spaced apart sufficient to receive the spool member with the hole through the sleeve portions and spool member in alignment. A pin carried by an air cylinder is movable, on command, between a retracted position with the spool member unattached, and an inserted position with the pin projected through the aligned openings (to thereby lock the spool members and strap end to the guide sleeve portions). The strap is guided for sliding movement through a pivotal arm in such a manner as to cause the spool portion to engage a seat formed in the end of the arm. The arm is limited in its pivotal movement and is so arranged as to exactly pivot the spool member when seated in the arm end, up into a position between the sleeve members.

The specifics of the invention will be more clearly understood and appreciated by reference to the following detailed description and drawings wherein.

Figure 1:
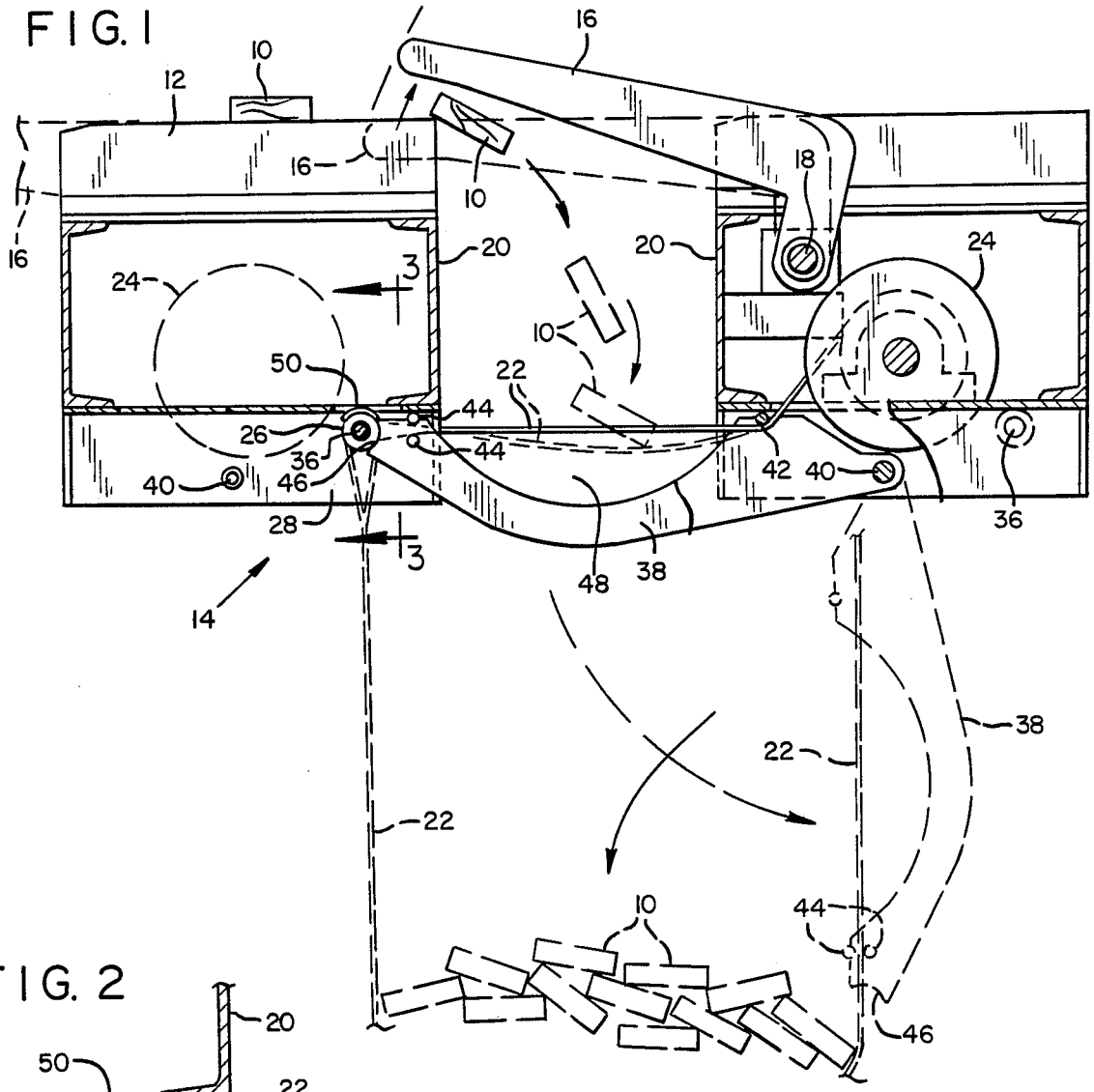
FIG. 1 illustrates a sorting mechanism utilizing the present invention.
Figure 2:
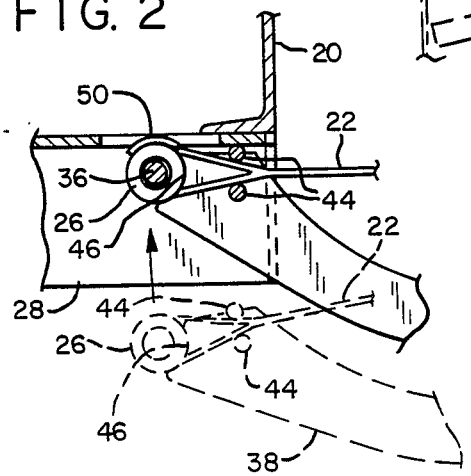
FIG. 2 is a view, partially in section, illustrating the arm member being utilized for relatching the strap end.

Referring to FIG. 1 of the drawings, it will be appreciated that lumber pieces 10 are drawn along slide rails 12 (e.g. by a drag chain not shown). Sorting bins 14 are provided at spaced positions below the rails as illustrated i.e. the sorting bin illustrated is only one of a number of bins located along the path of the lumber pieces. Gaps are provided in the slide rails in the areas directly over the bins. Continued sliding movement across the openings caused by these slide rail gaps is enabled by sorting levers 16. The sorting levers 16 are pivoted as at pivot 18, and operating mechanism (not shown) is activated to raise and lower the levers about the pivot 18. In FIG. 1, lever 16 is shown in a raised position in solid line and in a lowered position in dash lines. It will thus be appreciated that the operator determines which of the lumber pieces are of a particular grade type, and as the lumber pieces approach the appropriate sorting bin, lever 16 is raised and the selected lumber pieces are diverted into that bin.

The bin 14 is provided with various support braces and brackets for supporting the various apparatus components including side walls 20. The bottom is open except for straps 22 there across. It will be appreciated that in order to support the lumber pieces, at least two such straps are required. For example, if the lumber being sorted is 2 by 4s that are eight feet in length, the bin is eight feet plus in width and the straps may be located inwardly from each end between one and two feet. The straps are thus spaced apart between four and six feet. A convenient cross section dimension of the bin is one foot in length and a depth initially (i.e. the drop from the conveyor to the taut straps), of about 1.5 feet. Whereas only one strap and its support mechanism are shown, the reader will understand that a second strap and its support mechanism are contemplated and that the two mechanism function in concert.

The strap 22 has a substantial length with a major portion wound on a reel 24 that is mounted behind one wall 20 of the bin. The operating mechanism for the reel is not unique and it will suffice to explain that it is powered by a motor that can be manually or automatically operated to reel-out or reel-in the strap 22 as required for the sorting operation. The outer end of the strap is provided with a spool-like end member 26 (the strap end is looped around the end member).

As seen in FIG. 1, mounted below and behind the opposite side wall 20 are brackets 28 that fixedly carry a pair of spaced sleeve-like guide members 30. A further bracket 32 supports an air cylinder 34 which controls movement of a lock pin 36. The lock pin 36 is aligned with the spaced guide members 30 and is of a size and has a length of travel for insertion through the pair of guide members.

Figure 3:
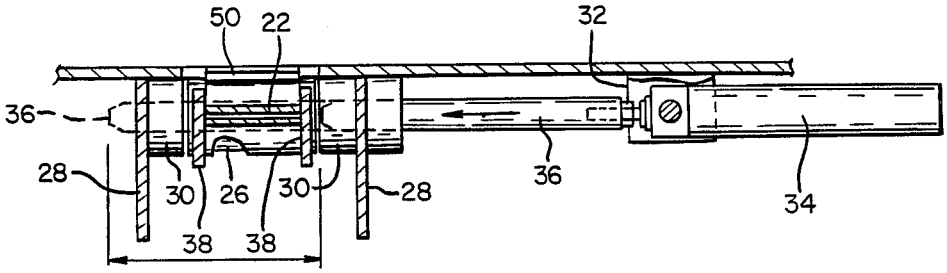
FIG. 3 is a view of the latching mechanism for the strap as taken on view lines 3—3 of FIG. 1.

The guide members are adapted to receive there between the spool like end member 26 fixed to the end of the strap. As seen in FIG. 3, with the end member 26 located between the guide members 30, and with the pin 36 extended through the spool (which has a center opening) and the guide members, the end member 26 and thus the strap end is held fast to the overhead apparatus at a position behind the sidewall 20.

Before explaining the arm member 38, the general function of the strap 22, the fastening mechanism therefore, and the reel 24 will be explained. As lumber pieces 10 are dropped into the bin and start to fill it, the reel 24 is activated to reel-out the strap 22. The reeling out function is controlled to ensure that the lumber pieces never drop greater than about the initial 1.5 feet. When the strap accumulates a desired quantity of the lumber pieces, the operator reels out the strap until the lumber pieces settle onto the floor below the bin. The air cylinder 34 is then activated to withdraw the pin 36 so that the end of the strap (secured to spool 26) is free to fall to the floor. The reel 24 then is reversed to reel in the strap end which is pulled out from under the lumber pile and then upwardly toward the reel 24. The strap end is then swung over to the guide members 30 to be refastened by the pin 36 which is the function of the arm 38 which will now be explained.

The arm 38 is pivoted at pivot point 40, just below the reel 24. Except for its connection to the strap 22, the arm is otherwise free to pivot about pivot point 40. At the free end of the arm is a pair of guide pins 44. These pins are spaced apart sufficiently to permit free sliding of the strap there between. The strap 22 is inserted through the arm and between the guide pins as shown. At the outer end of the arm is a limiting seat 46 that includes a passageway for the strap but prevents passage there-past of the spool-like member 26. The strap extends along the arm rearwardly (or upwardly as seen in dash lines in FIG. 1) and then under a bearing pin 42 located near the pivotal end of the arm. From the bearing pin the strap extends upwardly to the reel 24 (and note that the strap extends inwardly of the pivot 40).

In operation, as the strap is reeled in, it is being reeled through the limiting seat 46. When the spool-like member 26 engages the limiting seat of the arm 38, continued reeling in of the strap forces upward pivoting of the arm. (Note the alignment of strap 22 in the dash position of FIG. 1. A pulling force on the strap produces a moment arm of force around pivot 40 to thereby force pivoting of the arm.) As the arm is rigid and journaled at 40 so as to only move in a fixed pivotal arc, the continued reeling and pivoting of arm 38 pivots the end member 26 to its "home" position between guides 30. When in this home position, the air cylinder is activated to drive the lock pin 36 back through the guide members and spool member to reattach the strap end.

Of significance to the arm design is the spacing 48 that is created under the strap 22 when the strap is pulled taut across the bin bottom. This spacing is created by configuring the arm to support the guide pins 44 and bearing pin 42 outwardly of walls 20. The intermediate arm portion spanning the bin bottom, is offset downwardly from a straight line between the upper guide pin 44 and bearing pin 42. Thus the lumber pieces initially dropped into the bin (as illustrated) will be cushioned by the taut strap 22.

Also of importance is the simple mechanism for locking and unlocking the end fastener of the strap to the guide members 30. With the arm journaled as described, the pivotal movement of the arm upwardly automatically locates the end fastener (a stop member 50 is desirable so that the arm can simply be pivoted until it stops, at which location the spool end member is aligned with the openings in the guide members and the lock pin 36. The sliding operation of the air actuated pin 36 is simple and reliable with a minimum of moving parts. Maintenance is thereby reduced and replacement of these locking parts is inexpensive.

These and other advantages will be realized by an appreciation of the illustrated embodiment. It is subject to numerous modifications without departing from the inventive concept which is defined by the claims appended hereto.

I claim:

1. A lumber sorting apparatus comprising;

a bin having an open bottom and comprising at least two opposing side walls defining an opening therebetween, at least a pair of strong flexible straps spanning the open bottom from a first of said opposing side walls to the opposite side wall and having a length substantially longer than said opening between the side walls, a reel fixed to one end of each strap and mounted proximate to said first side wall, said reel including means for power winding the strap length onto and off of the reel, an arm member for each strap pivotally connected at one end proximate the reel and being pivoted between a vertical position and a horizontal position, said arm member including guide means defining a path for the strap with the strap projected through the guide means and thereby through the arm member, said strap being drawn through the arm member when winding the strap onto the reel, a spool having a center opening, said spool fastened to the opposite end of the strap, said arm member having a spool seat at its end opposite the pivotal connection, said spool seat positioned relative to the guide means of the arm member whereby the spool is seated in the spool seat by winding the strap onto the reel, said spool when seated in the spool seat preventing further drawing of the strap through the arm member, a fitting for receiving the spool, said fitting mounted proximate the opposite side wall, a pin slideably mounted proximate the fitting and power actuated for sliding engagement with the fitting and into the center opening of the spool when received by the fitting, for latching and relatching the spool to the fitting in a first position and unlatching the spool from the fitting in a second position, said arm member being pivoted through a fixed arc from the vertical to the horizontal position, where upon winding of the strap onto the reel, the spool becomes seated in the spool seat while the arm member is in the vertical position, and continued winding causes the arm member to pivot to the horizontal position to locate the spool in the fitting for relatching.

2. A lumber sorting apparatus as defined in claim 1 wherein the fitting is comprised of a pair of sleeve portions having center openings, said spool having a determined width through which the center opening of the spool extends, and the sleeve portions spaced apart the approximate distance of the spool width, and the center openings of the sleeve portions and spool member being aligned when the spool is received in the fitting for receiving the pin.

3. A lumber sorting apparatus as defined in claim 2 wherein a stop member is fixed relative to the sleeve portions to stop the upper movement of the spool when aligned between the sleeve portions.

4. A lumber sorting apparatus as defined in claim 3 wherein sliding of the pin is powered by an air cylinder.

* * * * *